US007541125B2

(12) United States Patent
Inagaki et al.

(10) Patent No.: US 7,541,125 B2
(45) Date of Patent: Jun. 2, 2009

(54) ORGANIC PHOTOCONDUCTOR, MANUFACTURING METHOD THEREOF, AND PROCESS CARTRIDGE AND IMAGE FORMATION APPARATUS USING THE SAME PHOTOCONDUCTOR

(75) Inventors: Keiichi Inagaki, Hino (JP); Nobuaki Kobayashi, Hachioji (JP); Shigeaki Tokutake, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 52 days.

(21) Appl. No.: 11/060,813

(22) Filed: Feb. 18, 2005

(65) Prior Publication Data

US 2005/0186494 A1 Aug. 25, 2005

(30) Foreign Application Priority Data

Feb. 24, 2004 (JP) ..... 2004-047451

(51) Int. Cl.
*G03G 5/043* (2006.01)

(52) U.S. Cl. ..... 430/66; 430/291; 430/56; 430/132; 399/159

(58) Field of Classification Search ..... 430/66, 430/56, 291, 132; 399/159
See application file for complete search history.

(56) References Cited

U.S. PATENT DOCUMENTS 5,077,163 A * 12/1991 Hayata et al. ..... 430/58.85
5,866,285 A * 2/1999 Anderson et al. ..... 430/41
6,258,499 B1 * 7/2001 Itami ..... 430/66
2003/0134209 A1 * 7/2003 Itami ..... 430/58.2

FOREIGN PATENT DOCUMENTS

| | | |
|---|---|---|
| JP | 6-250460 | 9/1994 |
| JP | 08-328287 | 12/1996 |
| JP | 8-328287 | 12/1996 |
| JP | 08328287 A * | 12/1996 |
| JP | 2003-215829 | 7/2003 |
| JP | 2003-270810 | 9/2003 |
| JP | 2003-345050 | 12/2003 |
| JP | 2004-004504 | 1/2004 |

OTHER PUBLICATIONS

JPO Action dated Feb. 12, 2008 (English Translation).

* cited by examiner

*Primary Examiner*—Christopher RoDee
*Assistant Examiner*—Peter L Vajda
(74) *Attorney, Agent, or Firm*—Finnegan, Henderson, Farabow, Garrett & Dunner, L.L.P.

(57) ABSTRACT

An embodiment may be an organic photoreceptor, which comprises a conductive support; a photosensitive layer provided on the conductive support; and a surface layer containing a binder and a fluorine-containing resin fine particle having a number average primary particle diameter between about 0.02 μm and about 0.20 μm and a crystallinity of less than 90% and a binder resin; wherein a contact angle of the surface layer for water is 90° or more and a dispersion of the contact angle is within ±2.0°.

18 Claims, 4 Drawing Sheets

ORGANIC PHOTOCONDUCTOR, MANUFACTURING METHOD THEREOF, AND PROCESS CARTRIDGE AND IMAGE FORMATION APPARATUS USING THE SAME PHOTOCONDUCTOR

BACKGROUND OF THE INVENTION

1. Field of the Invention

The present invention relates to an organic photoreceptor used in the field of a copying machine and printer, a manufacturing method of such an organic photoreceptor, and a process cartridge an image forming apparatus using this organic photoreceptor.

2. Related Art

In recent years, an organic photoreceptor (hereinafter also referred to as "photoreceptor") has been utilized over an extensive range in the electrophotographic photoreceptor. The organic photoreceptor has advantages over other types of photoreceptor, such as easier development of materials conforming to various types of light sources for exposure ranging from visible light to infrared light, possible selection of materials free of environmental pollution and lower production costs. However, the organic photoreceptor is characterized by poorer mechanical strength, easier deposition of foreign substances, poorer chemical resistance, earlier deterioration of electrostatic characteristics at the time of printing multiple sheets, and susceptibility to scratches on the surface.

To be more specific, an organic photoreceptor is required to have a sufficient resistance (wear resistance) to adhesion of foreign substances on the surface or damages caused by the external mechanical force applied when a toner image formed on the photoreceptor is transferred onto a transfer material such as paper or when toner remaining on the photoreceptor is removed by cleaning.

A method of impregnating the extreme surface of the photoreceptor with a fluorine-containing resin such as polytetrafluoroethylene (PTFE) is known in the prior art to improve the resistance of the photoreceptor to adhesion of foreign substances on the surface or damages. In particular, the art of using fine particles of fluorine-containing resin having a small crystallinity (the half-width of the X-ray diffraction peak: 0.28 or more) and a small diameter has been reported (Official Gazette of Japanese Patent Tokkaihei 8-328287 (claim 1 on page 2)) as a method of effectively reducing the friction coefficient on the surface of the photoreceptor to improve the wear resistance.

However, reduction in crystallinity will cause an increase in the spreading property of the fine particles of fluorine-containing resin and a decrease in dispersion stability of fine particles of fluorine-containing resin in the coating dispersion. This results in coagulation among particles, accompanied by difficulties in forming a membrane having uniform characteristics. Thus, black spots (strawberry-formed spotted image), black streaks or white streaks are formed on the electrophotographic image, with the result that a serious deterioration of the image occurs. Such problems have occurred in the prior art. In particular, in fine particles of fluorine-containing resin having a small crystallinity and an average particle diameter of less than 0.20 μm, there was a considerable reduction in the stability of coating dispersion of the fine particles of fluorine-containing resin. When film formation was made by the dip coating method for keeping this dispersion retained for a long time, it was difficult to form a surface layer having uniform surface energy because of the coagulum occurring in the dispersion, with the result that the aforementioned black spots, black streaks or white streaks were found out.

The art of using the fine particles of fluorine-containing resin having a small diameter is known as a method for effective reduction of a friction coefficient on the surface of the photoreceptor. Use of the fine particles having a small diameter is effective since it increases the surface area for the same number of parts to be added. However, as described above, when the diameter of fine particles of fluorine-containing resin having a small crystallinity was reduced, the uniformity in dispersion further deteriorated. It became difficult to form a uniform and smooth film free of coagula. Remarkable deterioration of the image quality was observed from the initial phase of printing.

SUMMARY

In view of the background described above, it is an object of the present invention to provide a new organic photoreceptor, a manufacturing method of such an organic photoreceptor, and a process cartridge and an image forming apparatus using this organic photoreceptor.

An embodiment of the present invention is an organic photoreceptor, which comprising:

a conductive support;

a photosensitive layer provided on the conductive support; and a surface layer containing a binder and a fluorine-containing resin particle having a number average primary particle diameter between about 0.02 μm and about 0.20 μm and a crystallinity of less than 90% and a binder resin;

wherein a contact angle of the surface layer for water is 90° or more and a dispersion of the contact angle is within ±2.0°.

DETAILED DESCRIPTION OF THE EXPLANATORY EMBODIMENT

Figure 1:
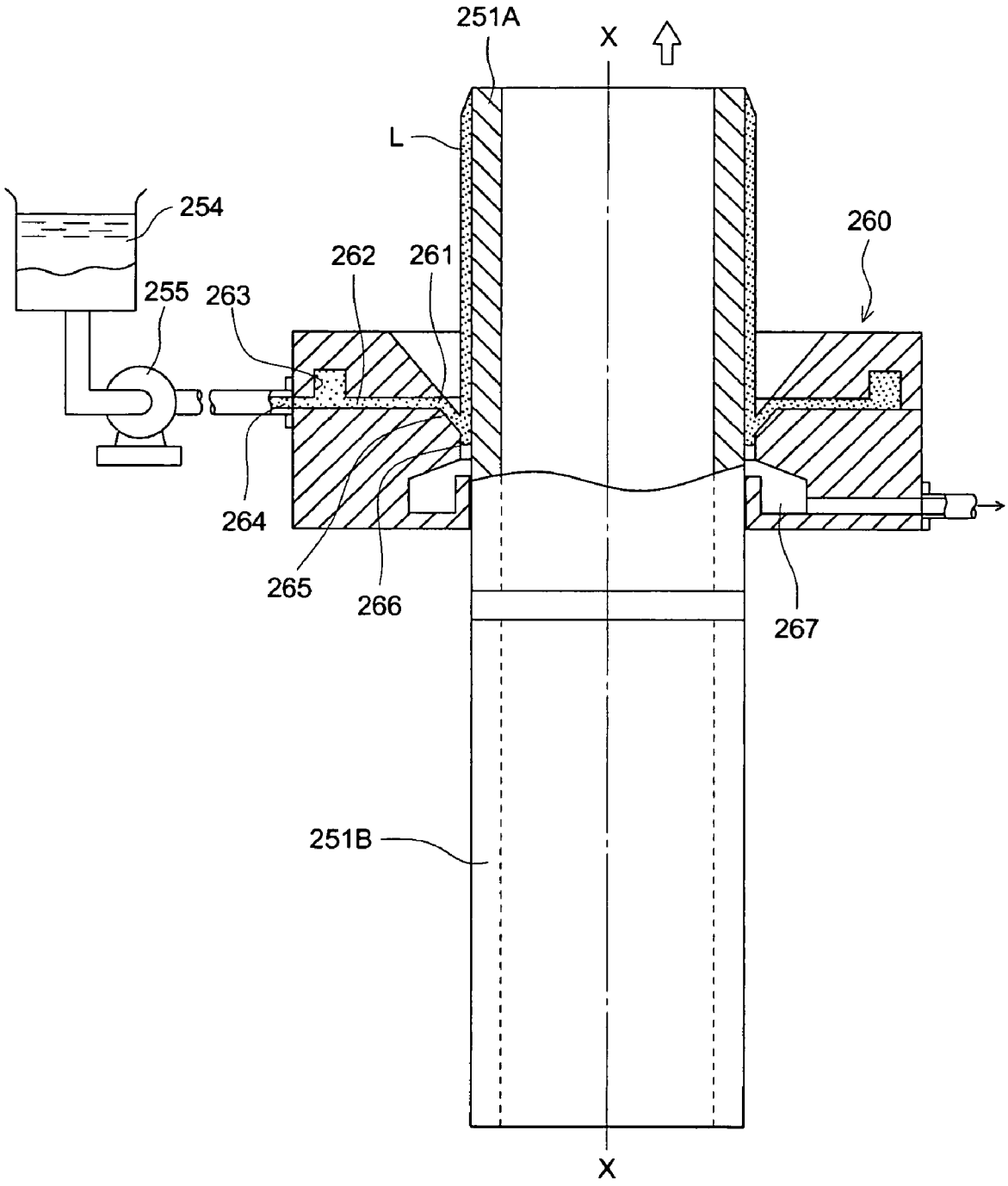
FIG. 1 is a cross sectional view showing an example of a circular type quantity-regulated coating machine of the present invention.

The present inventors have made a strenuous effort to solve the aforementioned problems and have found out that the dispersion property of the fine particles of fluorine-containing resin having a small crystallinity and a small diameter can be improved by uniform dispersion of the fine particles of fluorine-containing resin in the coating dispersion, and by forming the surface layer of uniform, low-surface energy, using the coating method wherein a coating dispersion is prepared in advance and this coating dispersion is used up before the coagula are produced thereby.

To be more specific, the present inventors have found out that an organic photoreceptor equipped with a surface layer of excellent uniformity and low surface energy can be formed by improving the dispersion property of the fine particles of fluorine-containing resin having a small crystallinity and a small diameter, and by coating the coating dispersion under a specific condition. This organic photoreceptor is preferred to have the following configuration:

An embodiment is concerned with an organic photoreceptor, having a photosensitive layer on the conductive support, comprising a surface layer containing:

fine particles of fluorine-containing resin having a number average primary particle diameter from 0.02 μm inclusive to 0.20 μm exclusive, and a crystallinity of less than 90%; and binder resins;

wherein the contact angle with respect to water is equal to or greater than 90°, and the variation of contact angle is within ±2.0°.

Another advantageous configuration can be achieved by the aforementioned configuration further characterized in that an electric charge transport layer consists of a plurality of layers, and the topmost layer containing:

fine particles of fluorine-containing resin having a number average primary particle diameter from 0.02 μm inclusive to 0.20 μm exclusive, and a crystallinity of less than 90%; and binder resins;

wherein the contact angle with respect to water is equal to or greater than 90°, and the variation of contact angle is within ±2.0°.

It is also advantageous when at least one of the aforementioned binder resins is made of siloxane modified polycarbonate, or the aforementioned fine particles of fluorine-containing resin coexist with an oxidant inhibitor.

To manufacture the photoreceptor, the following second embodiment is advantageous:

A method of manufacturing an organic photoreceptor having a photosensitive layer on a conductive support, comprising steps of:

preparing a coating solution by dispersing and dissolving the fine particles of fluorine-containing resins and binder resins in an organic solvent having a boiling point of 120° C. or less, wherein the fine particles of fluorine-containing resin having a number average primary particle diameter from 0.02 μm inclusive to 0.20 μm exclusive, and a crystallinity of less than 90%; and applying the coating solution using a coating apparatus of coating solution supply type;

wherein the contact angle with respect to water is equal to or greater than 90°, and the variation of contact angle is within ±2.0°.

Further, the aforementioned organic photoreceptor is preferably applicable to a process cartridge that can be mounted removably on an image forming apparatus, and to an image forming apparatus, wherein the photoreceptor is supported integrally with at least one of the following components:

a charging section to provide uniformly charging on the photoreceptor;

a latent image forming section to form an electrostatic latent image on the organic photoreceptor;

a developing section to develop the electrostatic latent image on the organic photoreceptor;

a transfer section to transfer a developed toner image on a transfer material;

an electric charge eliminator to eliminate electric charges from the organic photoreceptor subsequent to transfer; and a cleaning section to remove the remaining toner from the organic photoreceptor subsequent to transfer.

Use of an organic photoreceptor having such a configuration can ensure a uniform dispersion property of the fine particles of fluorine-containing resin in the surface layer, thereby improving black spots, uneven image and blurred image that have caused problems in the prior art on a long-term basis, and forming an electrophotographic image characterized by excellent sharpness. This configuration according to the present invention also provides a process cartridge and image forming apparatus using the organic photoreceptor.

The following describes the details:

An organic photoreceptor, having a photosensitive layer on the conductive support, comprising a surface layer containing:

the fine particles of fluorine-containing resin having a number average primary particle diameter from 0.02 μm inclusive to 0.20 μm exclusive, and a crystallinity of less than 90%; and binder resins;

wherein the contact angle with respect to water is equal to or greater than 90°, and the variation of contact angle is within ±2.0°.

The organic photoreceptor having the aforementioned configuration allows a high-quality electrophotographic image to be formed, by preventing the aforementioned black spots, black streaks or white streaks from occurring for a long period of time.

To be more specific, the fine particles of fluorine-containing resin were characterized by poor dispersion uniformity, and it was difficult to form a uniform and smooth film free of coagula, as described above. Namely, when the fine particles of fluorine-containing resins have a crystallinity of less than 90% and a high degree of spreading property, it is difficult to maintain the dispersed particles of these resins in the dispersion, and to form a surface layer uniform contact angle, due to coagulation of the dispersed particles. The present invention improves the dispersion property of the fine particles of fluorine-containing resin of low crystallinity, having a number average primary particle diameter from 0.02 μm inclusive to 0.20 μm exclusive, and forms the surface layer where the contact angle with respect to water is equal to or greater than 90° and the variation of contact angle is within ±2.0°. Thus, an organic photoreceptor that can prevent the aforementioned black spots, black streaks or white streaks from occurring for a long period of time, and allows a high-quality electrophotographic image to be formed can be provided.

For the surface layer having the aforementioned properties, the coagulation among fine particles of fluorine-containing resin can be reduced and a stable dispersion can be prepared, by dispersing the fine particles of fluorine-containing resin having a number average primary particle diameter from 0.02 μm inclusive to 0.2 μm exclusive, and a crystallinity of less than 90%, using a solvent having a low boiling point and an excellent dispersion property, preferably an organic solvent having a boiling point not exceeding 120° under the atmospheric pressure (e.g. THF, ethanol, toluene, dichloroethane). At the same time, the surface layer is formed using a coating apparatus of coating solution supply type wherein this dispersion is employed as a coating solution, and the surface is then dried. These steps prevent coagulation of the fine particles of fluorine-containing resin in the surface layer, thereby forming a surface layer characterized by reduced variations in the angle of contact with respect to water.

The aforementioned coating apparatus of coating solution supply type refers to a coating apparatus wherein the coating solution required for layer formation is supplied onto the conductive support for coating operation, and includes a quantity-regulated coating machine and a spray coating machine. Such a coating apparatus of coating solution supply type allows the surface layer to be formed in the one-way operation, as compared to the dip coating method where the conductive support is dipped in the coating solution. The dispersed fine particles of fluorine-containing resin enables a uniform surface layer to be formed wherein there is little coagulation of the fine particles of fluorine-containing resin, without being subjected to coagulation share in the dispersion. Moreover, the dispersion is prepared for each production of the photoreceptor. This avoids coagulation of the dispersion due to secular change and permits coating to be performed at the time of surface layer formation, wherein the lower layer already formed on the conductive support is not dissolved.

The method of coating with a quantity-regulated coating machine is most preferable to the aforementioned coating apparatus of coating solution supply type, when the dispersion using the aforementioned low-boiling point solvent is employed as a coating solution. In the case of a circular photoreceptor, it is preferred to coat it with the circular quantity-regulated coating machine described in details in the Official Gazette of Japanese Patent Tokkaisho 58-189061.

The following gives a brief description of the circular quantity-regulated coating machine.

Figure 2:
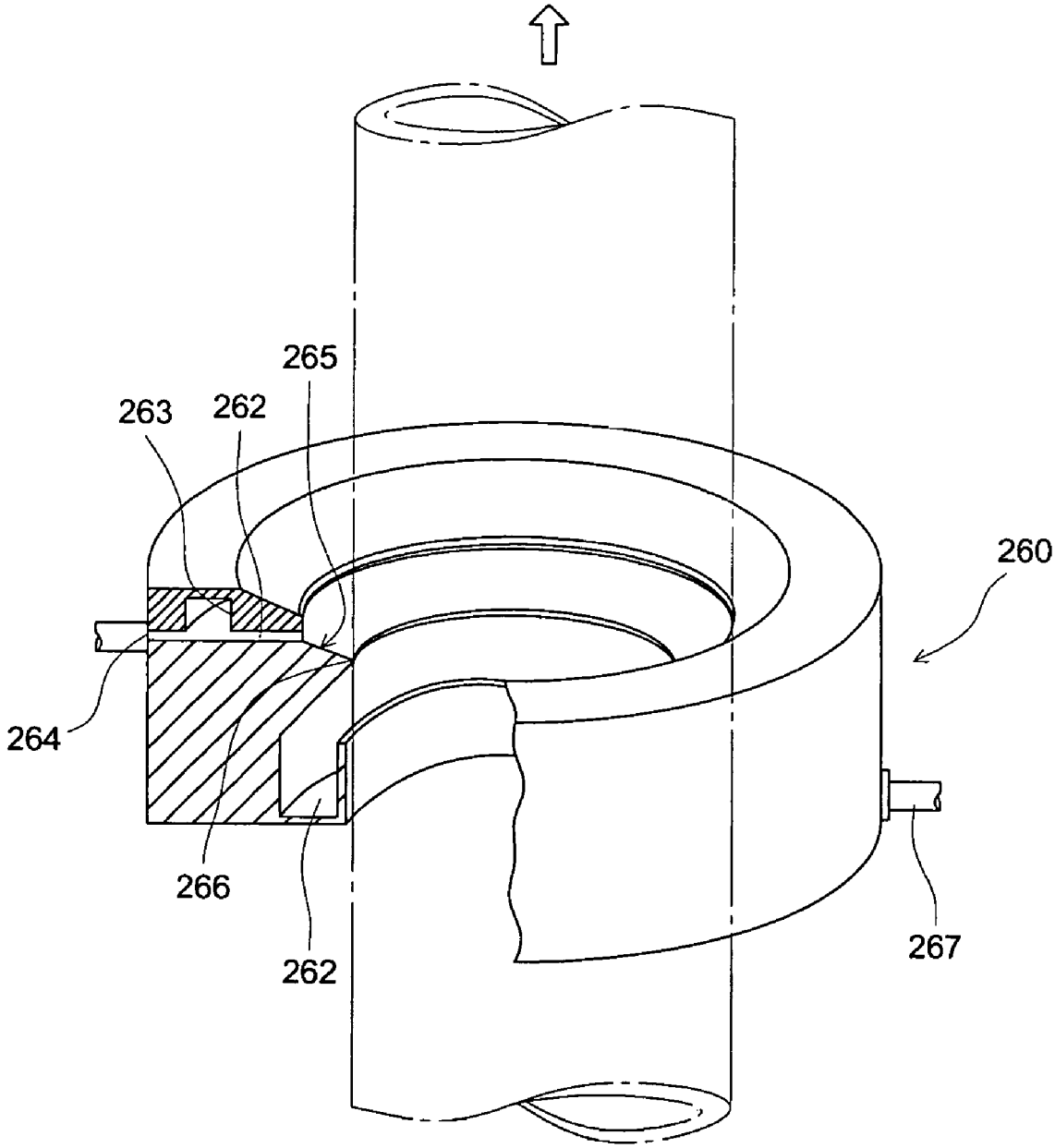
FIG. 2 is a perspective view showing an example of a circular type quantity-regulated coating machine of the present invention.

The dispersion solution with fine particles of fluorine-containing resin dispersed therein can be effectively coated using a circular quantity-regulated coating machine. In an example of the circular quantity-regulated coating machine, the cylindrical substrates 251A and 251B arranged one on top of the other in the perpendicular direction along the centerline x are raised in the arrow marked direction on a continuous basis, as shown in the cross sectional view of FIG. 1. Coating solution L is coated by the portion 260 (abbreviated as a coating head), enclosing them, directly involved in the coating operation of a slide hopper type coating machine with respect to the outer peripheral surface of the cylindrical substrate 251. A hollow drum, for example, an aluminum drum and plastic drum, or a seamless belt type substrate can be used as the substrate. As shown in FIG. 2, the coating head 260 is provided with a narrow coating solution distribution slit 262 (abbreviated as a slit) having a coating solution outlet 261 opened toward the substrate 251, wherein this coating solution outlet 261 is formed in the horizontal direction. The slit 262 communicates with an annular coating solution distribution chamber 263, and the coating solution L of a storage tank 254 is put into the annular coating solution distribution chamber 263 by the pressure pump 255. In the meantime, a slide surface 265, having a continuous downward inclination, for forming a terminal having the dimension a little greater than the outer dimension of the substrate, is provided on the lower side of the coating solution outlet 261 of the slit 262. Further, a lip-like portion 266 extending downward from the terminal of this slide surface 265 is provided. In the coating operation by such a coating machine, the coating solution L is pushed out of the slit 262 in the process of lifting the substrate 251 and is made to flow downward along the slide surface 265. Then the photosensitive solution having reached the terminal of the slide surface forms beads between the terminal of the slide surface and substrate 251, and is then coated on the surface of the substrate. Excess photosensitive solution is discharged from the discharge port 267.

The slide surface terminal and substrate are arranged with a certain gas between them, and can be coated with coating solution, without the subject to substrate being damaged, or without the already coated layer being damaged when the multiple layers having different properties are formed.

In the aforementioned method of coating with the circular quantity-regulated coating machine, the slide surface terminal and substrate are arranged with a certain gas between them, and can be coated with coating solution, without the subject to substrate being damaged, or without the already coated layer being damaged when the multiple layers having different properties are formed. Further, in the formation of a plurality of layers having different properties and dissolvable in the same solvent, the time of staying the solvent is much shorter than that in the dip coating method. This arrangement ensures coating operation to be completed, with the components of the lower layer hardly solving out into the upper layer or coating reservoir. Thus, coating work can be done without the dispersion property of the fine particles of fluorine-containing resin being deteriorated. The components described in the U.S. Pat. Nos. 5,707,449 and 5,587,266 are incorporated in the aforementioned circular quantity-regulated coating machine.

The fine particles of fluorine-containing resin have a number average primary particle diameter from 0.02 μm inclusive to 0.20 μm exclusive. If the number average primary particle diameter is less than 0.02 μm, the stability of the dispersion solution will deteriorate and coagulation among fine particles of fluorine-containing resins will occur. This will make uniform dispersion difficult and will cause increased variations in the angle of contact, with the result that the aforementioned black spots are easily formed. If the number average primary particle diameter is greater than 0.20 μm, coagulated particles will be easily produced by flocculation, and variations in the angle of contact will be increased. Thus, the aforementioned black spots will be more likely to occur, and at the same time, the image exposure of laser beam or the like will scatter and the sharpness of the image will deteriorate.

The number average primary particle diameter (D1) can be measured by observing the cross section of the photoreceptor. To be more specific, a desired 100 particles are selected from a photograph taken by a transmission electron microscope (acceleration voltage: 200 kV) and the Feret's diameter is measured to get the number average primary particle diameter (D1).

When the angle of contact with respect to water is less than 90°, the toner contains a greater amount of deposits of the inorganic external additives such as silica, and black spots tend to occur. Further, there will be an increase in frictional drag with the contact member of the photoreceptor such as a cleaning blade, and the amount of wear will be increased by fretting, so that streak-like irregularities of the image will occur and sharpness of the image will deteriorate more easily. The more preferred contact angle is 95° or more without exceeding 120°. If the contact angle has exceeded 120°, the amount of fine particles of fluorine-containing resin in the surface layer becomes excessive and the surface layer becomes soft. Fretting tends to occur, with the result that a blurred image will occur easily. In the meantime, if the variation of contact angle is out of the range ±2.0°, the dispersion property of the fine particles of fluorine-containing resin on the surface layer will be uneven, and inorganic components in the toner or paper powder, for example, inorganic external additives such as silica and titanium oxide in the toner, or the talc component will be embedded into the surface layer, with the result that black spots tend to be produced. Black and white streaks also tend to be produced. The variation in the contact angle is more preferred to be within ±1.7°.

Measurement of Contact Angle and its Variation

The contact angle in the sense is defined as the angle of contact to the surface of a photoreceptor with respect to pure water (at 20° C.). The contact angle of the photoreceptor is obtained by measuring the contact angle with respect to pure water using a contact angle meter (Model CA-DT.A by Kyowa Kaimen Kagaku Co., Ltd.) at 20° C., 50% relative humidity.

The variation of the contact angle was measured at 20° C., 50% relative humidity. This measurement was started after repeated image formation of at least 1,000 sheets, when the photoreceptor has conformed to the image formation. When the photoreceptor was cylindrical, measurement was carried out at three positions—at the center and 5 cm from the right and left ends, and at four positions at each 90° in the circumferential direction—i.e. at a total of 12 positions. The average of these measurements was assumed as the contact angle, and the values farthest from this average value in the positive and negative directions were assumed as variations. Similarly, when the photoreceptor was a sheet, measurement was carried out at three positions—at the center and 5 cm from the right and left ends, and at four positions at an equally spaced interval—i.e. at a total of 12 positions. The average of these measurements was assumed as the contact angle of the present invention, and the values farthest from this average value in the positive and negative directions were assumed as variations. In this case, the aforementioned center refers to the center with respect to the length in the perpendicular direction relative to the rotating direction of the photoreceptor.

The fine particles of fluorine-containing resin have a number average primary particle diameter from 0.02 μm inclusive to 0.20 μm exclusive, and a crystallinity of less than 90%. If the crystallinity is 90% or more, the dispersion property of the fine particles of fluorine-containing resin will be improved, but the spreading property of the fine particles of fluorine-containing resins per se will be reduced, and the variation of contact angle tends to increase. There is no lower limit of the aforementioned crystallinity so long as an object of the present invention can be achieved. If the crystallinity of the fine particles of fluorine-containing resin is too small, spreading property will be excessive and the dispersion property tends to deteriorate; therefore, the fine particles of fluorine-containing resins are preferred to have a crystallinity of 40% or more.

To measure the crystallinity of the fine particles of fluorine-containing resin, the diffraction peak having occurred is separated into crystalline and non-crystalline portions according to wide-angle X-ray diffraction measurement. After baseline correction, the measurement is expressed in terms of the percentage of the X-ray integrated intensity of the crystalline portion (numerator) over the full X-ray integrated integrity of the crystalline and non-crystalline portions (denominator).

In the present invention, measurements were made using the following wide-angle X-ray diffraction measuring apparatus under the following measuring conditions. If the same results as those by the wide-angle X-ray diffraction measuring apparatus can be obtained, another measuring instrument can be utilized.

X-ray generator: Rigaku RU-200B

Output: 50 kV, 150 mA

Monochromator: Graphite

Radiation source: CuKα (0.154184 nm)

Scanning range: $3 \leqq 2\theta \leqq 60$

Scanning method: θ-2θ

Scanning rate: 2/min

As a material which constitutes fluorine-containing resin fine particles, it is desirable to use a homopolymer or a copolymer of a fluorine-containing polymerizable monomer, or a copolymer of a fluorine-containing polymerizable monomer and a fluorine free polymerizable monomer.

A fluorine-containing polymerizable monomer is a monomer expressed with a general formula;

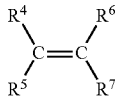

(In the formula, at least one group among $R^4$-$R^7$ is a fluorine atom, and the remaining groups are a hydrogen atom, a chlorine atom, a methyl group, a monofluoro methyl group, a difluoro methyl group, or a trifluoro methyl group independently, respectively). As a desirable fluorine-containing polymerizable monomer, ethylene tetrafluoride, ethylene trifluoride, ethylene chloride trifluoride, propylene hexafluoride, vinyl fluoride, vinylidene fluoride, ethylene dichloride difluoride, etc. may be listed. As a fluorine-containing polymerizable monomer, two or more kinds of monomers may be used.

As a fluorine free polymerizable monomer, vinyl chloride etc. may be listed, for example. As a fluorine free polymerizable monomer, two or more kinds of monomers may be used.

Among the constituting materials, it may be preferable to constitute any fluorine-containing resin fine particles by a homopolymer or a copolymer of a fluorine-containing polymerizable monomer, it may be more preferable to use a poly ethylene tetrafluoride(PTFE), poly ethylene trifluoride, and ethylene tetrafluoride-propylene hexafluoride copolymer and polyvinylidene fluoride, and it may be especially preferable to use poly ethylene tetrafluoride.

The number average molecular weight of a polymer which constitutes a fluorine-containing resin fine particle is not restricted especially as far as a purpose of the present invention can be attained, however usually the range of 10,000 to 1 million is suitable.

Although the degree of crystallinity of fluorine-containing resin fine particles changes according to the construction materials of the fluorine-containing resin fine particles, it is changed also by conducting heat-treating for the fluorine-containing resin fine particles. For example, if PTFE fine particles (polyethylene terephthalate fine particles) whose number average first order particle diameter is 0.12 μm and degree of crystallinity is 91.3 are heat-treated for 65 minutes at 250° C., degree of crystallinity can be reduced to 82.8. A heat treatment means in particular is not restricted, but a well-known dryer or a well-known heating furnace can be used.

As a binder resin in the above-mentioned surface layer, it is desirable to use a resin which has a surface activity group to help the dispersibility of fluorine-containing resin fine particles in a partial structure of the resin, for example, it is desirable to use polycarbonate and polyarylate which have a siloxane group in a partial structure. Especially, siloxane-converted polycarbonate which has a siloxane group shown below in a partial structure is desirable.

(PC-1)

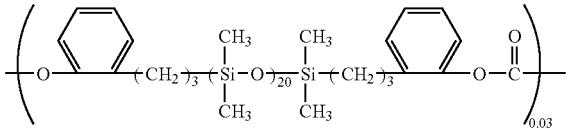

-continued

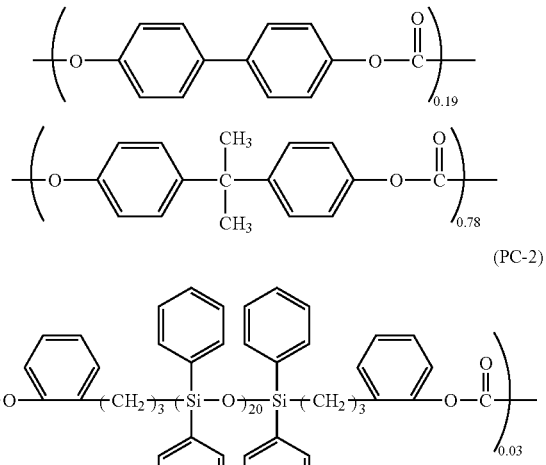

(PC-2)

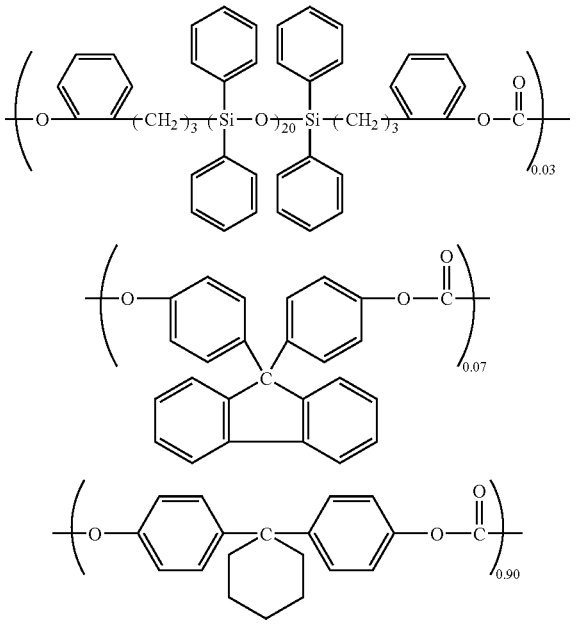

(PC-3)

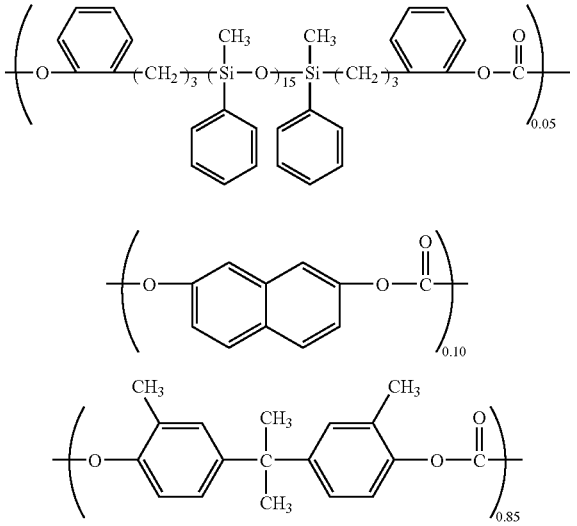

(PC-4)

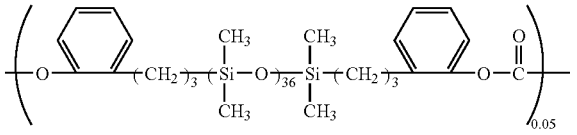

-continued

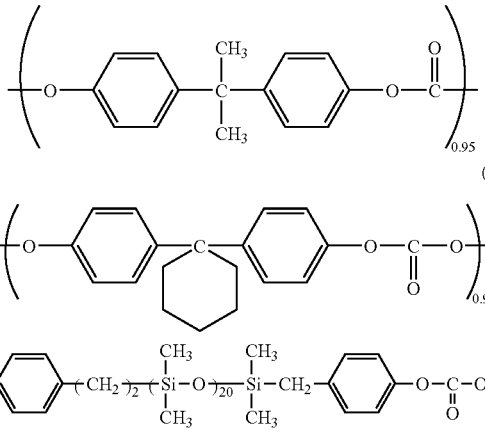

(PC-5)

As for viscosity average molecular weight, 10,000-100,000 are desirable.

Further, to form by using the fluorine-containing resin fine particles a surface layer whose contact angle for water is 90° or more and dispersion in a contact angle is ±2.0°, it is desirable to make the ratio of the fluorine-containing resin fine particles in the surface layer high, it is desirable to use it by an amount of at lest more than 20 mass parts and below 200 mass parts to 100 mass parts of the binder resin by a mass ratio. With this range, it is easy to form the surface layer satisfying both conditions that a contact angle for water is 90° or more and a dispersion in a contact angle is ±2.0°. Moreover, a surface layer becomes firm and it is hard to generate an abrasion mark etc.

The following describes the configuration of the organic photoreceptor other than the surface layer:

The organic photoreceptor refers to an electrophotographic photoreceptor equipped with at least one of an electric charge generating function essential to the configuration of the electrophotographic photoreceptor, and an electric charge transport function. It includes all the photoreceptors composed of the commonly known organic charge generating substances or organic charge transfer substances, and the known organic photoreceptors such as the photoreceptor wherein the charge generating function and charge transfer function are provided by the high-molecular complex.

There is no restriction to the configuration of the photoreceptor if the photoreceptor contains the fine particles of fluorine-containing resin having a number average primary particle diameter from 0.02 μm inclusive to 0.20 μm exclusive, and a crystallinity of the X-ray diffraction pattern peak of less than 90%, wherein the contact angle with respect to water is equal to or greater than 90°, and the variation of contact angle is within ±2.0°. It includes the following configurations:

1) A configuration wherein the photosensitive layer includes an electric charge generating layer and electric charge transport layer laid sequentially one on top of the other on a conductive support.

2) A configuration wherein the photosensitive layer includes an electric charge generating layer and the first and second electric charge transport layers laid sequentially one on top of another on a conductive support.

3) A configuration wherein the photosensitive layer includes a single layer containing an electric charge transport material and an electric charge generating material laid on a conductive support.

4) A configuration wherein the photosensitive layer includes an electric charge transport layer and electric charge generating layer laid sequentially one on top of the other on a conductive support.

5) A configuration of the photoreceptor described in the aforementioned 1) through 4) wherein a surface protective layer is further provided.

The photoreceptor can be made in any one of the aforementioned configurations. The surface layer of the photoreceptor is the layer in contact with the air boundary. When a single layer photosensitive layer alone is formed on the conductive support, this photosensitive layer corresponds to the surface layer. When a single layer or a laminated photosensitive layer and surface protective layer are laid on the conductive support, the surface protective layer serves as an extreme surface layer. In the photoreceptor, the configuration (2) is most preferably used. In the photoreceptor, the substrate layer may be formed on the conductive support, prior to the formation of the photosensitive layer, independently of the type of configuration adopted.

The electric charge transport layer can be defined as a layer having a function of transporting the electric charge carrier generated on the electric charge generating layer due to light exposure, to the surface of the organic photoreceptor. Specific detection of the electric charge transport function can be confirmed by laying the electric charge generating layer and electric charge transport layer on the conductive support, and by detecting the photoconductivity.

The following describes a specific configuration of the photosensitive layer, with reference to an example of the layer configuration (2) that is most preferable:

Conductive Support:

A sheet-like or cylindrical conductive support may be used as the conductive support for the photoreceptor.

The cylindrical conductive support can be defined as a cylindrical support required to form images on an endless basis through rotation. The preferred cylindricity is 5 through 40 μm, and the more preferred one is 7 through 30 μm.

The cylindricity is based on the JIS (B0621-1984). To be more specific, when a cylindrical substrate is sandwiched between two coaxial geometrical cylinders, the cylindricity is expressed in terms of the difference of the radii at the position where a space between two coaxial cylinders is minimized. In the present invention, the difference in the radii is expressed in "μm". The cylindricity is gained by measuring the roundness at a total of seven points—two points 10 mm from both ends of the cylindrical substrate, a center, and four points obtained by dividing the space between both points and the center into three equal parts. A non-contact type universal roll diameter measuring instrument (by Mitsutoyo Co., Ltd.) can be used for this measurement.

The conductive support may include a metallic drum made of aluminum, nickel or the like, a plastic drum formed by vapor deposition of aluminum, tin oxide, indium oxide or the like, or a paper/plastic drum coated with conductive substance. The conductive support is preferred to have a specific resistance of $10^3$ Ωcm or less at the normal temperature.

A conductive support wherein the alumite film provided with porous sealing treatment on the surface is formed may be used. Alumite treatment is normally carried out in the acid bath containing a chromium oxide, sulfuric acid, oxalic acid, phosphoric acid, sulfamic acid or others. In sulfuric acid, the best result is obtained by anodization. In the case of anodization in sulfuric acid, preferred conditions include a sulfuric acid concentration of 100 through 200 g/l, aluminum ion concentration of 1 through 10 g/l, liquid temperature of around 20° C., and applied voltage of about 20 volts, without the preferred conditions being restricted thereto. The average thickness of the film formed by anodization is normally equal to or smaller than 20 μm, and is preferred to be equal to or smaller than 10 μm, in particular.

Intermediate Layer:

An intermediate layer equipped with barrier function can be provided between the conductive support and photosensitive layer.

To improve the adhesion between the conductive support and photosensitive layer and to avoid injection of electric charge from the support, an intermediate layer (including the substrate layer) can be provided between the support and photosensitive layer. The intermediate layer is made of a polyamide resin, polyvinyl chloride resin, vinyl acetate resin or copolymer resin including two or more recurring units of these resins. Polyamide resin is a preferred material as the resin where the residual potential increased by the repeated use of these substrate resins can be reduced. The preferable film thickness of the intermediate layer using these resins is 0.01 through 0.5 μm.

The preferable intermediate layer includes the intermediate layer made of the metallic resin created by thermosetting the organic metal compounds such as silane coupling agent and titanium coupling agent. The preferable film thickness of the intermediate layer is 0.1 through 2 μm.

The preferable intermediate layer includes the one obtained by dispersing the inorganic particles in the binder resin. The preferable average diameter of the inorganic particles is 0.01 through 1 μm. The particularly preferred one is the intermediate layer obtained by dispersing the N-type semiconducting fine particles in the binder. It can be exemplified by the intermediate layer prepared by dispersing the titanium oxide in the polyamide resin, wherein this titanium oxide has been subjected to silica/alumina treatment and surface treatment by silane compound, and has an average particle diameter of 0.01 through 1 μm. The preferable film thickness of the intermediate layer is 1 through 20 μm.

The N-type semiconducting fine particles refer to the ones that convert conductive carriers into electrons. Converting conductive carriers into electrons refers to the property of effectively blocking the hole injection from the substrate by containing the N-type semiconducting fine particles in the insulating binder, without blocking the electron from the photosensitive layer.

The following describes the method of identifying the N-type semiconducting particles.

An intermediate layer having a film thickness of 5 μm (intermediate layer formed by using a dispersion having 50 wt % of particles dispersed in the binder resin constituting the intermediate layer) is formed on the conductive support. This intermediate layer is negatively charged and the light damping property is evaluated. Further, it is positively charged, and the light damping property is evaluated in the same manner.

The N-type semiconducting particles are defined as the particles dispersed in the intermediate layer in cases where the light damping property, when negatively charged in the aforementioned evaluation, is greater than that when positively charged.

The N-type semiconducting particles include the particles of titanium oxide ($TiO_2$), zinc oxide (ZnO) and tin oxide ($SnO_2$), and the titanium oxide is preferable.

The number average primary particle diameter is preferably 10 nm or more without exceeding 500 nm, more preferably 10 through 200 nm, and particularly preferably 15 nm through 50 nm.

The intermediate layer using the N-type semiconducting particles where the number average primary particle diameter is within the aforementioned range permits dispersion in the layer to be made more compact, and is provided with sufficient potential stability and black spot preventive function.

In the case of titanium oxide, for example, the number average primary particle diameter of the aforementioned N-type semiconducting particles is scales up 10,000 times by a transmission electron-microscope. Random 100 particles are observed as primary particles, and a number average diameter of the Feret's diameter is obtained by image analysis in this measurement.

The N-type semiconducting particles are configured in a branched, needle-shaped or granular form. These N-type semiconducting particles—for example, in the case of titanium oxide—are available in various crystal types such as anatase type, rutile structure and amorphous type. Any of these crystal types may be utilized. A combination of two or more crystal types may also be used. Of these types, the rutile type is particularly preferred.

In one of the methods for surface treatment by hydrophobing applied to the N-type semiconducting particles, surface treatment is carried out several times, and the last surface treatment operation in the surface treatment conducted several times is the one conducted by using a reactive organic silicon compound. It is preferred that at least one surface treatment operation in the process of surface treatment conducted several times should use the one using at least one of alumina, silica and zirconium. It is also preferred that the surface treatment using the reactive organic silicon compound should be conducted in the final operation.

Treatment by alumina, silica and zirconium refers to the treatment wherein alumina, silica and zirconium are deposited on the surface of the N-type semiconducting particles. The alumina, silica and zirconium deposited on the surface contain the hydrates of alumina, silica and zirconium. The surface treatment of reactive organic silicon compound is the treatment made by using the reactive organic silicon compound as a treatment solution.

As described above, uniform coating (surface treatment) of the surface of the N-type semiconducting particles is ensured by conducting surface treatment of the N-type semiconducting particles such as titanium oxide at least twice. If the N-type semiconducting particles having been subjected to surface treatment are used in the intermediate layer, it is possible to get a photoreceptor characterized by excellent dispersion property of the N-type semiconducting particles such as titanium oxide particles used in the intermediate layer, and by complete absence of an image defect such as a black spot.

Light Sensitive Layer Charge Generating Layer

Although the above-mentioned titanyl phthalocyanine-added pigment can be used for an organic photoreceptor as electric charge occurrence substance, in addition, phthalocyanine pigments, an azo pigment, a perylene pigment, an azulenium pigment, etc. can be used together.

In case of using a binder as a dispersing medium of a CGM in the charge generating layer, a known resin can be employed for the binder, and the most preferable resins are butyral resin, silicone resin, silicone modification butyral resin, phenoxy resin. The ratio between the binder resin and the charge generating material is preferably binder resin 100 weight part for charge generating material 20 to 600 weight part. Increase in residual electric potential with repeated use can be minimized by using these resins. The layer thickness of the charge generating layer is preferably in the range of 0.3 to 2 mm.

Charge Transporting Layer

As described above, the structure which constitutes the charge transporting layer from plural charge transporting layers and make a charge transporting layer of the top layer contain fluorine based resin particles is desirable.

A charge transporting layer contains a charge transporting material (CTM) and a binder resin for dispersing the CTM and forming a layer. In addition to the fluorine based resin particles, the charge transporting layer may contain additives such as an antioxidant agent if necessary.

As a charge transporting material (CTM), a known charge transporting material (CTM) of the positive hole transportation type (P type) can be used. For example, triphenylamines, hydrazones, styryl compound, benzidine compound, butadiene compound can be applied. These charge transporting materials are usually dissolved in a proper binder resin to form a layer.

As the binder resin for charge transporting layer (CTL), any one of thermoplastic resin and thermosetting resin may be used. For example, polystyrene, acryl resin, methacrylic resin, vinyl chloride resin, vinyl acetate resin, polyvinyl butyral resin, epoxide resin, polyurethane resin, phenol resin, polyester resin, alkyd resin, polycarbonate resin, silicone resin, melamine resin range and copolymer resin including more than repetition units of two resins among these resins may be usable. Further, other than these insulation-related resin, high polymer organic semiconductor such as poly-N-vinyl carbazole may be usable. The most preferred material is polycarbonate resin in view of, smaller water absorbing rate, dispersing ability of the CTM and electro photosensitive characteristics.

Ratio of the binder resin is preferably 50 to 200 parts by weight to 100 parts of charge transporting material by weight.

Moreover, it is desirable to make the surface layer containing the fluorine-containing resin fine particles contain an antioxidant. Although the surface layer containing a fluorine-containing resin fine particles tends to oxidize with activated gas at the time of charging of a photoreceptor, for example, NOx, ozone, etc., and easily generates a blur image, the occurrence of a blur image can be prevented by making an antioxidant exist together with it. Here, as an added amount of the antioxidant, 0.1 parts to 50 parts is to 100 parts of binders in the surface phase, preferably 0.5 parts to 25 parts. The antioxidant is a material, as a typical one, having a character to prevent or control an action of oxygen under conditions, such as light, heat, and electric discharge, to an auto-oxidizing substance which exists in an organic photoreceptor or on the surface of an organic photoreceptor. Typically, the following compound groups are listed up.

1-1
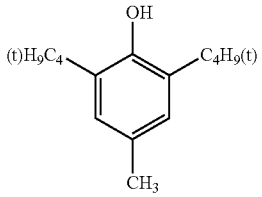
1-2
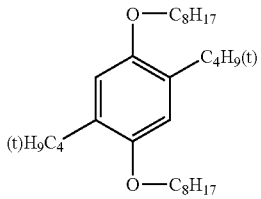
1-3
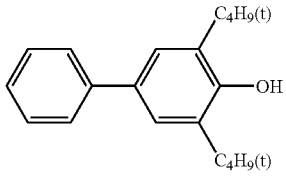
1-4
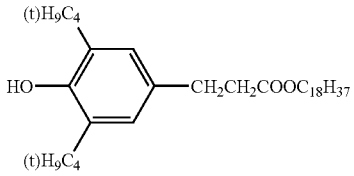
1-5
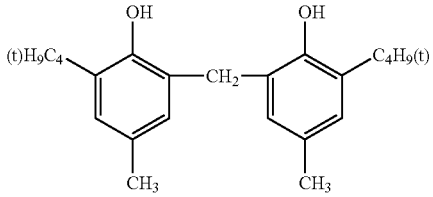
1-6
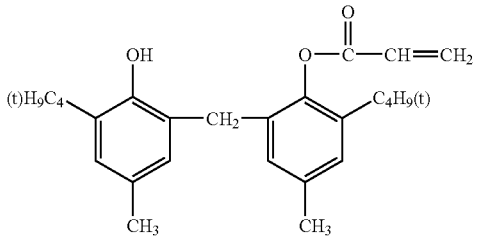
1-7
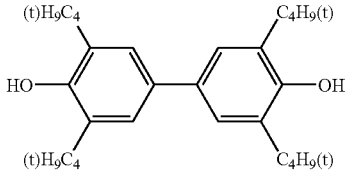
1-8
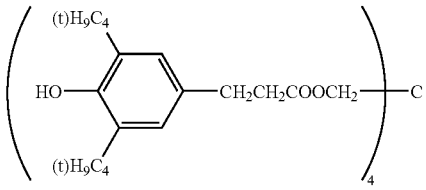
1-9
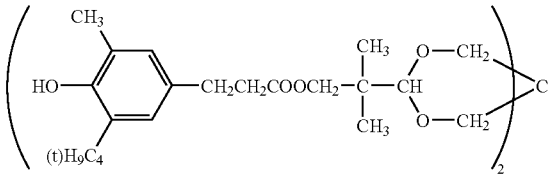
1-10
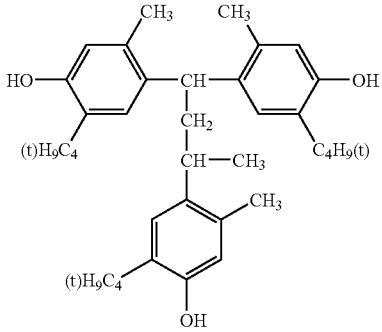
2-1
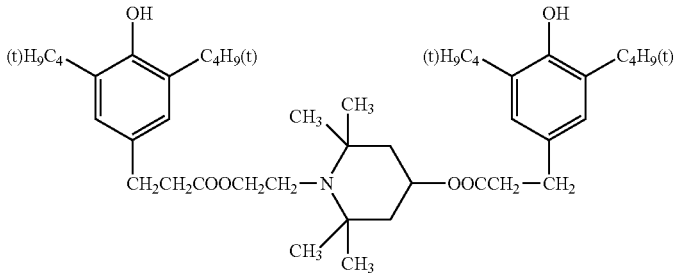

-continued 2-2

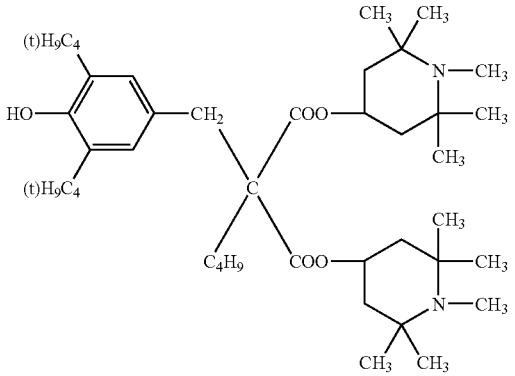

2-3

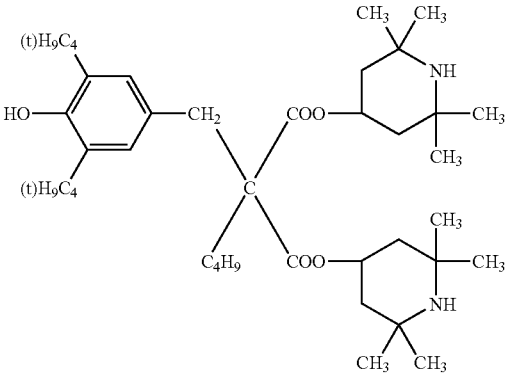

2-4

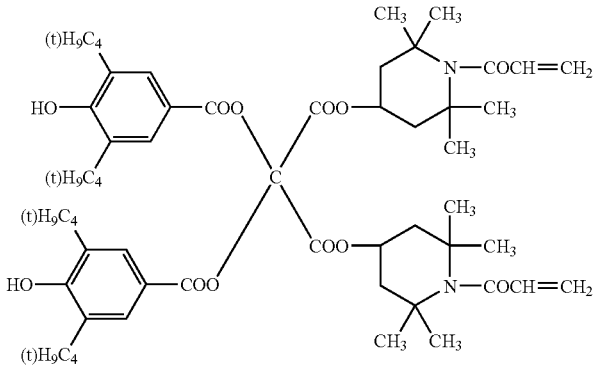

2-5

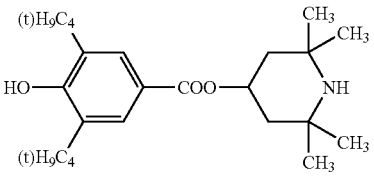

2-6

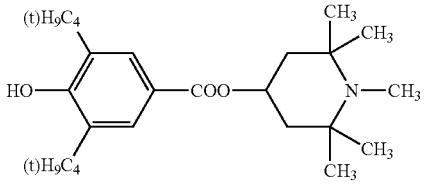

2-7

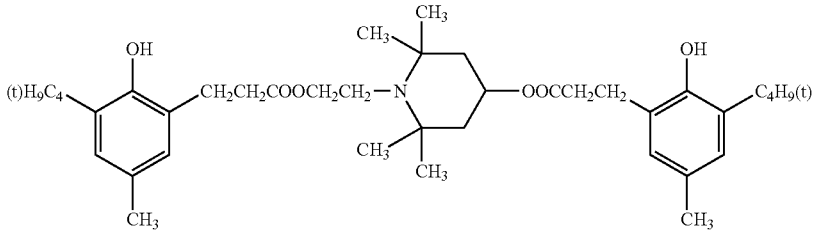

As a solvent or a dispersion medium used for forming an intermediate layer, a photosensitive layer and a protective layer, n-butylamine, diethylamine, ethylenediamine, isopropanolamine, triethanolamine, triethylenediamine, N,N-dimethylformamido, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethyl sulfoxide and methyl cellosolve may be listed. The present invention is not restricted to these one, dichloromethane, 1,2-dichloro ethane and methyl ethyl ketone are used preferably. Further, these solvents or dispersion media may also be used either independently or as mixed solvents of two or more types.

Figure 3:
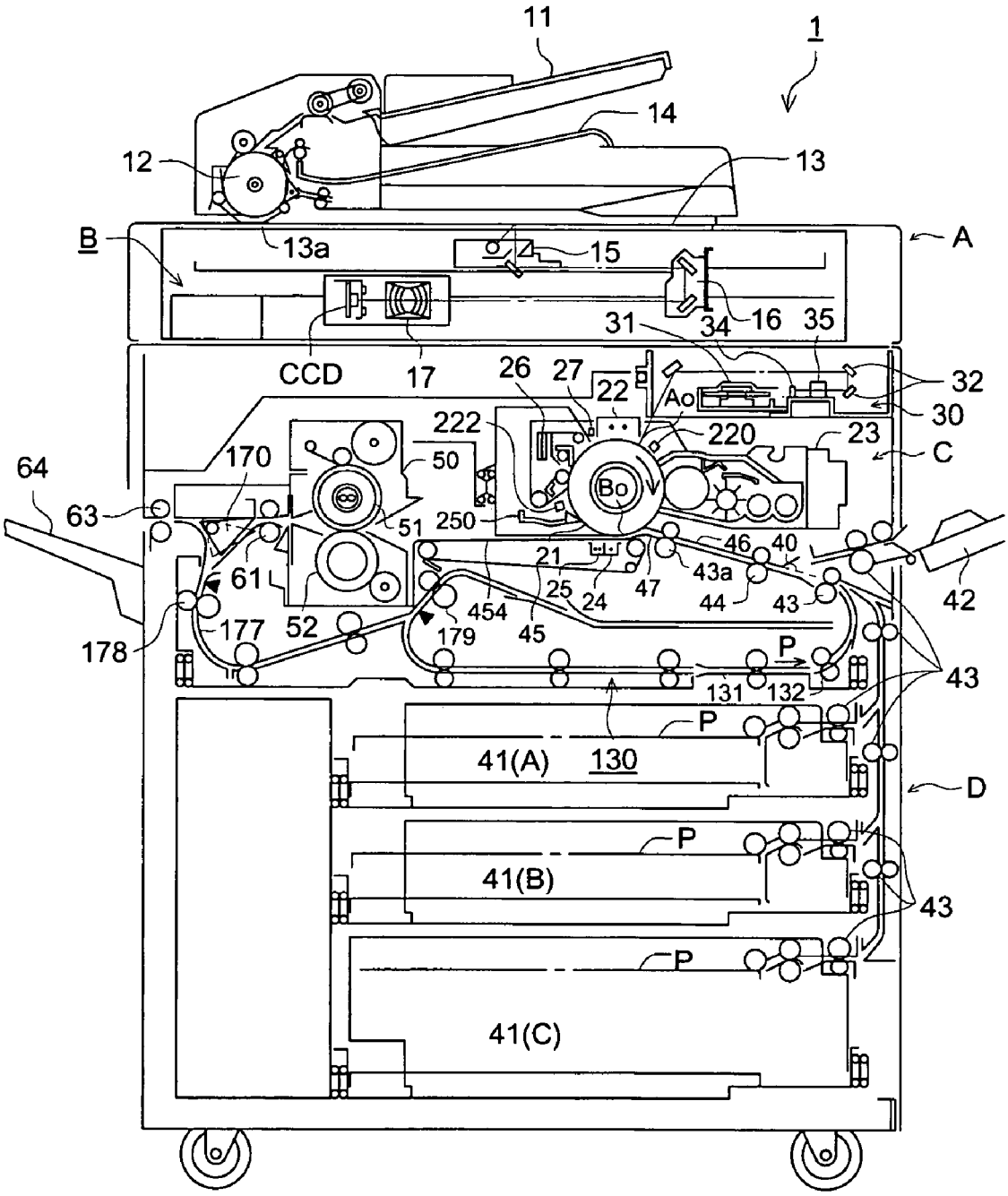
FIG. 3 is a schematic view wherein the functions of the image forming apparatus of the present invention are incorporated.

The following describes the image forming apparatus using an organic photoreceptor:

The image forming apparatus 1 shown in FIG. 3 is a digital image forming apparatus. It comprises an image reading section A, an image processing section B, an image forming section C, and a transfer paper conveyance section D as a transfer paper conveyance means.

An automatic document feed means for automatically feeding documents is arranged on the top of the image reading section A. The documents placed on the document platen as conveyed sheet by sheet by means of a document conveying roller 12, and the image is read at the reading position 13*a*.

The document having been read is ejected onto a document ejection tray 14 by the document conveying roller 12.

In the meantime, the image of the document placed on the plate glass 13 is read by the reading operation at the speed v by the first mirror unit 15 consisting of an illumination lamp constituting a scanning optical system and a first mirror, and by the movement of the second mirror unit 16 consisting of the second and third mirrors located at the V-shaped position at the speed v/2 in the same direction.

The scanned images are formed on the light receiving surface of an image-capturing device (CCD) as a line sensor through the projection lens 17. The linear optical images formed on the image-capturing device (CCD) are sequentially subjected to photoelectric conversion into electric signals (luminance signals). Then they are subjected to analog-to-digital conversion, and then to such processing as density conversion and filtering in the image processing section B. After that, image data is stored in the memory.

The image forming section C as an image forming unit comprises:

a drum-formed photoreceptor 21 as an image carrier;

a charging device (charging process) 22 for charging the photoreceptor 21 on the outer periphery;

a potential detecting section 220 for detecting the potential on the surface of the charged photoreceptor;

a developing section (developing process) 23;

a transfer/conveyance belt apparatus 45 as a transfer section (transfer process);

a cleaning apparatus (cleaning process) 26 for the photoreceptor 21; and a PCL (pre-charge lamp) 27 as an optical electric charge eliminator (residual potential eliminating process).

These components are arranged in the order of operations. Further, a reflected density detecting section 222 for measuring the reflected density of the patch image developed on the photoreceptor 21 is provided downstream from the developing section 23. An organic photoreceptor of the present invention is used as the photoreceptor 21, and is driven in the clockwise direction as illustrated.

The rotating photoreceptor 21 is electrically charged uniformly by the charging device 22. After that, image exposure is performed based on the image signal called up from the memory of the image processing section B by the exposure optical system as an image exposure section (image exposure process) 30. In the exposure optical system as an image exposure section 30—a writing section—, the optical path is bent by a reflection mirror 32 through a rotating polygon mirror 31, fθ lens 34, and cylindrical lens 35, using the laser diode (not illustrated) as a light emitting source, whereby main scanning is performed. Exposure is carried out at position Ao with reference to the photoreceptor 21, and an electrostatic latent image is formed by the rotation (sub-scanning) of the photoreceptor 21.

In the image formation method, when an electrostatic latent image is formed on the photoreceptor, image exposure is preferably carried out using the exposure beam having a spot area of $2\times10^{-9}$ $m^2$. Even in the case of such a small-diameter beam exposure, the organic photoreceptor of the present invention is capable of faithfully forming the image corresponding to this spot area. The more preferable spot area is $0.01\times10^{-9}$ through $1\times10^{-9}$ $m^2$, with the result that excellent image quality characterized by at least 400 dpi (dpi: number of dots per 2.54 cm) and 256 gradations is achieved.

The aforementioned spot area of the exposure beam is represented in terms of the area where the intensity of this beam corresponds to the light intensity of $1/e^2$ of the peak intensity.

The exposure beam to be used includes the beams of the scanning optical system using the semiconductor laser and solid scanner such as an LED and liquid crystal shutter. The distribution of the light intensity includes gauss distribution and Lorenz distribution. The portion corresponding to up to $1/e^2$ of each peak intensity is assumed as a spot area.

The electrostatic latent image on the photoreceptor 21 is subject to reverse development by the developing section 23, and a visible toner image is formed on the surface of the photoreceptor 21. According to the image forming method of the present invention, polymerized toner is utilized as the developer for this developing section. An electrophotographic image of better sharpness can be achieved when the polymerized toner having a uniform shape and particle size is used in combination with the organic photoreceptor of the present invention.

Polymerized toner in the sense is used here refers to toner obtained such that the production of binder resin for toner and the shape of the toner is formed by the polymerization of the material monomer of the binder resin and subsequent chemical treatment. To put it more specifically, polymerized toner refers to the toner gained by suspension polymerization, emulsion polymerization and subsequent fusion process among particles if required.

The polymerized toner is prepared by polymerization subsequent to uniform dispersion of material monomer in a water-based material. This arrangement provides the toner having a uniform particle size distribution and shape.

Polymerized toner can be manufactured by the suspension polymerization method and the method of manufacturing a trace quantity of polymerized particles are manufactured through emulsion polymerization of the monomer in the solution with emulsified liquid of the required additive added thereto, wherein association is performed thereafter by addition of organic solvent and coagulant. There are a method of preparing the polymerized toner by association through mixture with dispersion such as releasing agent and coloring agent required for the formation of toner, and a method of emulsion polymerization subsequent to dispersing toner components such as releasing agent and coloring agent in the monomer.

To be more specific, a coloring agent and, if required, releasing agent and electric charge inhibitor as well as polymerization initiator are added in the polymerized monomer. Various component materials are dissolved or dispersed into the polymerized monomer using a homogenizer, sand mill, sand grinder an ultrasonic pulverizer. The polymerized monomer with these component materials dissolved or dispersed therein is dispersed into oil drops having a desired size as toner in the water-based solvent containing the dispersion stabilizer, using the homomixer and homogenizer. After that, the polymerized monomer is moved into the reactor whose agitation mechanism is made of the agitation blade (to be described later) and is heated therein, thereby promoting polymerization. After reaction, the dispersion stabilizer is removed and the polymerized monomer is filtered, cleaned and dried, whereby toner is prepared.

The toner can also be prepared by association or fusion of resin particles in a water-based medium. Examples of this method are found in the Official Gazette of Japanese Patent Tokkaihei 5-265252, Official Gazette of Japanese Patent Tokkaihei 6-329947 and Official Gazette of Japanese Patent Tokkaihei 9-15904, without being restricted thereto. To be more specific, a plurality of resin particles and dispersed particles of the component materials such as a coloring agent, or resins and fine particles consisting of coloring agents are associated. Especially, after dispersing them in water using an emulsifier, a coagulant having a coagulation concentration in excess of the critical level is added thereto, and the process of salting-out is performed. At the same time, these substances are subjected to heating and fusing above the glass transition point temperature of the formed polymer per se, so that the particle size is gradually increased by growth while fused particles are formed. When the intended particle size has been reached, much water is added to suspend the increase of the particle size. Further heating and agitation are continued until the particle surface becomes smooth, and the shape is controlled. These particles in the state of containing water are heated and dried in the fluid condition, whereby toner is formed. In this case, it is possible to add an organic solvent as well as coagulant to water, wherein the organic solvent is subjected to infinite dissolution.

Japanese Patent Tokkai 2000-214629 describes the details of the material, manufacturing method and polymerized toner reactor required to prepare the toner having a uniform factors such as a geometry factor used in the present invention.

In the transfer paper conveyance section D, sheet feed units 41(A), 41(B) and 41(C) as a transfer sheet storage means are arranged below the image forming unit, wherein the transfer sheets P having different sizes are stored. A manual sheet feed unit 42 for manual feed of the sheets of paper is provided on the side. The transfer sheets P selected by either of the two are fed along a sheet conveyance path 40 by a guide roller 43, and are temporarily suspended by the sheet feed registration roller 44 for correcting the inclination and deviation of the transfer sheets P. Then these transfer sheets P are again fed and guided by the sheet conveyance path 40, pre-transfer roller 43*a*, paper feed path 46 and entry guide plate 47. The toner image on the photoreceptor 21 is transferred to the transfer sheet P at the transfer position Bo by a transfer electrode 24 and a separator electrode 25, while being carried by the transfer/conveyance belt 454 of the transfer/conveyance belt apparatus 45. The transfer sheet P is separated from the surface of the photoreceptor 21 and is brought to a fixing apparatus 50 as a fixing means by the transfer/conveyance belt apparatus 45.

The fixing apparatus 50 contains a fixing roller 51 and a pressure roller 52. When the transfer sheet P passes between the fixing roller 51 and pressure roller 52, toner is fixed in position by heat and pressure. With the toner image having been fixed thereon, the transfer sheet P is ejected onto the ejection tray 64.

The above description is concerned with the case where an image is formed on one side of the transfer sheet. In the case of duplex copying, the ejection switching member 170 is switched and the transfer sheet guide 177 is opened. The transfer sheet P is fed in the direction of an arrow showed in a broken line.

Further, the transfer sheet P is fed downward by the conveyance device 178 and is switched back by the sheet reversing section 179. With the trailing edge of the transfer sheet P becoming the leading edge, the transfer sheet P is conveyed into the sheet feed unit 130 for duplex copying.

The conveyance guide 131 provided on the sheet feed unit 130 for duplex copying is moved in the direction of sheet feed by the transfer sheet P. Then the transfer sheet P is fed again by the sheet feed roller 132 and is led to the sheet conveyance path 40.

As described above, the transfer sheet P is again fed in the direction of the photoreceptor 21, and the toner image is transferred on the reverse side of the transfer sheet P. After the image has been fixed by the fixing section 50, the transfer sheet P is ejected to the ejection tray 64 through a roller pair 63.

The image processing apparatus can be configured in such a way that the components such as the aforementioned photoreceptor, developing device and cleaning device are integrally combined into a process cartridge, and this unit is removably mounted on the apparatus proper. It is also possible to arrange such a configuration that at least one of the charging device, image exposure device, developing device, transfer electrode, separator electrode and cleaning device is supported integrally with the photoreceptor, so as to form a process cartridge that, as a removable single unit, is mounted on the apparatus proper, using a guide means such as a rail of the apparatus proper.

Figure 4:
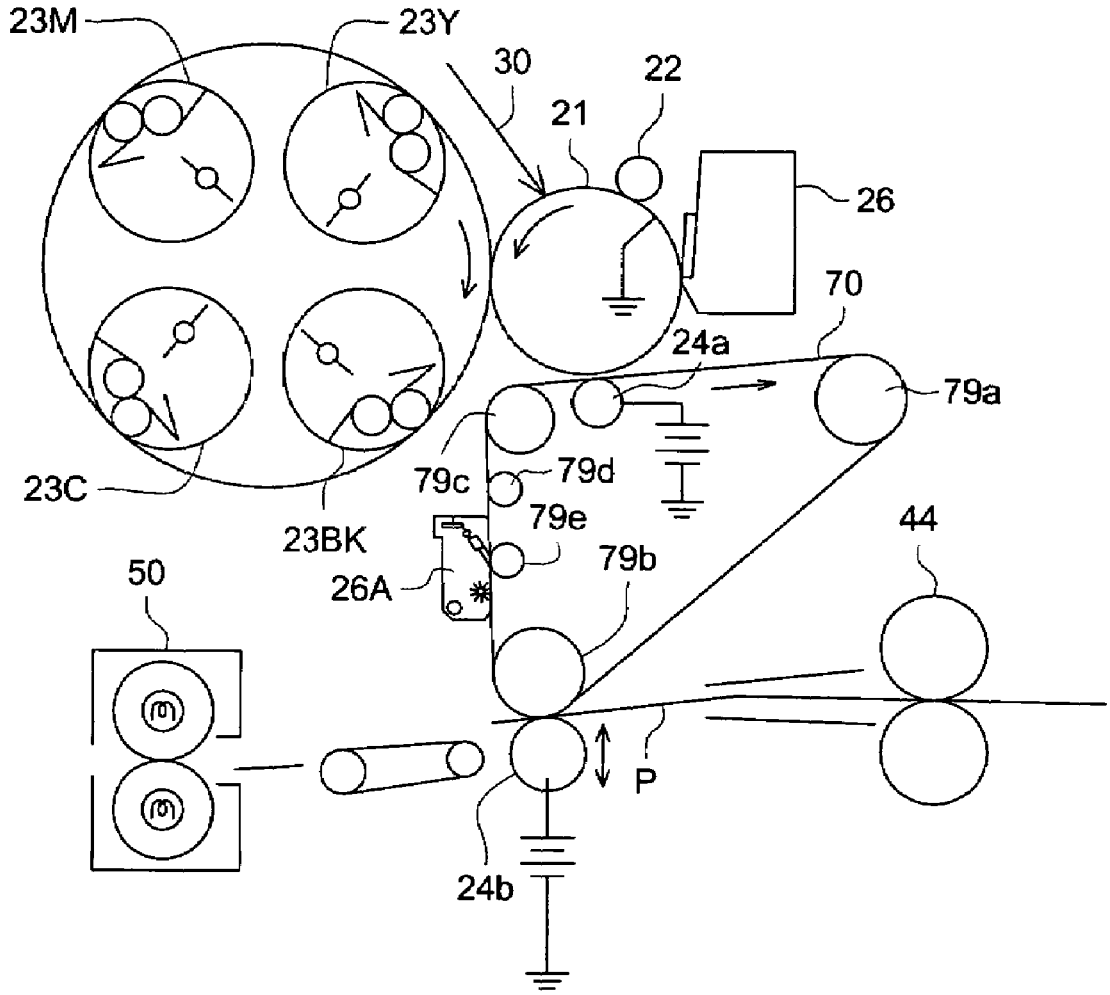
FIG. 4 is a configuration cross sectional view of an example of a color image forming apparatus using the organic photoreceptor of the present invention.

FIG. 4 is a configuration cross sectional view of a color image processing apparatus (a copying machine or laser beam printer equipped with at least a charging device, an exposure section, a plurality of developing sections, a transfer section, a cleaning section and an intermediate transfer member arranged around the organic photoreceptor) using the organic photoreceptor of the present invention. The belt-like intermediate transfer member 10 is made of an elastic body of medium resistance.

Numeral 21 denotes a rotary drum type photoreceptor used repeated as an image forming member, and is driven at a predetermined peripheral speed in the counterclockwise direction marked by an arrow.

While rotating, the rotating photoreceptor 21 is electrically charged by the charging section 22 uniformly to get a predetermined polarity and potential. Then image exposure is carried out by the scanning exposure beam of the laser beam modulated in conformity to the time-series electric digital image signal of image information by an optical exposure section 30 (not illustrated). This procedure forms an electrostatic latent image corresponding to the yellow (Y) color component image as the intended color image.

Then the electrostatic latent image is developed by the first yellow (Y) toner by means of the yellow (Y) developing section 23Y (yellow color developing section). In this case, the second through fourth developing sections 23M, 23C and 23Bk (magenta, cyan and black developing sections) are disabled and does not act on the photoreceptor 21. The aforementioned first yellow toner image is not affected by the second through fourth developing sections.

The intermediate transfer member 70 is tightened by the rollers 79*a*, 79*b*, 79*c*, 79*d* and 79*e*, and is driven in the clockwise direction at the same peripheral speed as the photoreceptor 21.

The first yellow toner image formed on the photoreceptor 21 and carried thereby is transferred sequentially onto the outer peripheral surface of the intermediate transfer member 70 on an intermediate basis, by the electric field created by the primary transfer bias applied to the intermediate transfer member 70 from the primary transfer roller 24*a* in the process of passing through the nip between the image forming apparatus 1 and intermediate transfer member 70.

A cleaning apparatus 26 is used to clean the surface of the photoreceptor 21 on which the first yellow toner image corresponding to the intermediate transfer member 70 has been transferred.

In the same manner, the second magenta toner image, third cyan toner image and fourth black toner image are sequentially superimposed and transferred on the intermediate transfer member 70, whereby a superimposed color toner image corresponding to the intended color image is formed.

Supported by a bearing in parallel corresponding to the secondary transfer opposing roller 79*b*, a secondary transfer roller 24*b* is arranged detachably on the lower surface of the intermediate transfer member 70.

The primary transfer bias for sequential transfer by superimposition from the photoreceptor 21 to the intermediate transfer member 70 is reverse in polarity to that of the toner, and is applied from a bias power source. The applied voltage, for example, ranges from +100 V to +2 kV.

In the primary transfer process of the first through third color toner images from the photoreceptor 21 to the intermediate transfer member 70, the secondary transfer roller 24*b* and intermediate transfer member cleaning section 26A can be separated from the intermediate transfer member 70.

The following describes the process of transfer to the transfer sheet P as a secondary carrier of the toner image transferred by superimposing onto the belt-shaped intermediate transfer member 70. The secondary transfer roller 24*b* is brought in contact with the belt of the intermediate transfer member 70, and the transfer sheet P is fed to the nip section of the belt of the intermediate transfer member 70 in contact with the secondary transfer roller 24*b* from a pair of sheet feed registration rollers 44 through a transfer paper guide at a predetermined timed interval. The secondary transfer bias applied to the secondary transfer roller 24*b* from the bias voltage source. Then the color toner image is by superimposition transferred (secondarily) onto the transfer sheet P as a secondary image carrier from the intermediate transfer member 70 by the secondary transfer bias. The transfer sheet P with the toner image transferred thereon is led into the fixing apparatus 50, where the transfer sheet P is heated and fixed.

The organic photoreceptor in the present invention is applicable to such an electrophotographic apparatus in general as an electrophotographic copying machine, laser printer, LED printer and liquid crystal shutter type printer. Further, it is also applicable over a wide range to a display, recorder, light printer, prepressing machine and facsimile machine that are based on electrophotographic technology.

EXAMPLES

Although examples are given and this invention is hereafter explained to details, the aspect of this invention is not limited to this. Incidentally, "part" in the following sentences represents "parts by weight".

Manufacture of Photoreceptor 1

The photoreceptor 1 was produced as follows.

The surface of cylinder type aluminum base support was subjected to a cutting process, and a conductive base support of surface roughness Rz=1.5 (μm) was prepared.

<Intermediate Layer>

The following intermediate layer dispersion liquid was diluted twice with the same mixed solvent, and filtered after settling for overnight (filter; NihonPall Ltd. company make RIGIMESH 5 μm filter), whereby the intermediate layer coating solution was produced.

| | |
|---|---|
| Polyamide resin CM8000 (made by Toray Industries, Inc.) | 1 part |
| Inorganic particles: Titanium oxide (number average first order particle diameter of 35 nm: titanium oxide subjected to a silica alumina process and a methyl hydrogen polysiloxane process) | 3 parts |
| Methanol | 160 parts |

The above-mentioned composites were mixed, dispersion was performed for 10 hours by a batch system, using a sand mill as a homogenizer, and whereby intermediate layer dispersion liquid was produced.

On the above-mentioned base support, the above-mentioned coating solution was coated so that it became 1.0 μm of thickness of dried coating.

<Electric Charge Generating Layer (CGL)>

| | |
|---|---|
| Electric charge occurrence material (CGM): oxititanyl phthalocyanine (titanylphthalocyanine which has the maximum diffraction peak at 27.3° of the Bragg angle (2θ ± 0.2°) by X-ray diffraction spectrum with Cu-Kα characteristic-X-rays) | 24 parts |
| Polyvinyl butyral resin "Eslek BL-1" (made by Sekisui Chemical Co., Ltd.) | 12 parts |
| 2-butanone/cyclohexanone = 4/1 (v/v) | 300 parts |

The above-mentioned compositions were mixed and dispersed using the sand mill, thereby a charge generation layer coating solution was prepared. This coating liquid was applied by a dip coating method on the interlayer, thereby an electric charge generating layer of 0.5 μm dry film thickness was formed.

<Charge Transporting Layer 1 (CTL1)>

| | |
|---|---|
| Electric charge transportation material (4,4'-dimethyl-4"-(α-phenyl styryl) triphenylamine) | 225 parts |
| Polycarbonate (Z300: manufactured by a Mitsubishi Gas Chemical Company INC. company) | 300 parts |
| Antioxidant (Irganox1010: made by Ciba-Geigy Japan) | 6 parts |
| Dichloromethane | 2000 parts |
| Silicone oil (KF-54: made by Shin-Etsu Chemical Co., Ltd. company) | 1 Part |

The above-mentioned compositions were mixed and dissolved, thereby a charge transporting layer coating solution 1 was prepared. This coating solution was coated on the above-mentioned charge generation layer by the immersion coating method, and was subjected to a dry process at 110° C. for 70 minutes, whereby the charge transporting layer of 18.0 μm of dried coating layer thickness was formed.

<Preparation of Polytetrafluoroethylene Resin Particle (PTFE Particles) Dispersion Liquid>

PTFE particles (PTFE particles having a number average first order particle diameters of 0.12 μm and a degree of crystallinity 91.3) were heat-treated for 40 minutes at 250° C. to make the degree of crystallinity to 82.8, and the following PTFE particle dispersion liquid was prepared using the PTFE particles.

| | |
|---|---|
| PTFE particles (PT1: number average first order particle diameters of 0.12 μm, and degree of crystallinity of 82.8) | 200 parts |
| Toluene | 600 parts |
| Fluorine based comb type graft polymer (a product name GF300, manufactured by Toagosei Co., Ltd. Chemistry) | 15 parts |

After mixing the above-mentioned compositions, the resultant mixture was dispersed with a sand grinder (manufactured by Amex company) using glass bead, and whereby PTFE particle dispersion liquid was prepared.

<Charge Transporting Layer 2 (CTL2)>

| | |
|---|---|
| PTFE particle dispersion liquid | 815 parts |
| Electric charge transportation materials (4,4'-dimethyl-4"-(α-phenyl styryl) triphenylamine) | 150 parts |
| Siloxane-modified polycarbonate resin (PC-1) | 150 parts |
| Polycarbonate (Z300: manufactured by a Mitsubishi Gas Chemical Company INC. company) | 150 parts |
| Antioxidant (Irganox1010: made by Ciba-Geigy Japan) | 12 parts |
| THF: Tetrahydrofuran | 2800 parts |
| Silicone oil (KF-54: made by a Shin-Etsu Chemical Co., Ltd. company) | 4 Parts |

The above-mentioned compositions were mixed and dissolved, thereby a charge transporting layer 2 coating solution was prepared. This coating solution was coated on the above-mentioned charge transporting layer by a circular slide hopper type coating apparatus, and was subjected to a dry process at 110° C. for 70 minutes, whereby the charge transporting layer of 2.0 μm of dried coating layer thickness was formed.

Production of Photoreceptors 2-12

In production of the photoreceptor 1, photoreceptors 2-12 were produced in the similar way with the photoreceptor 1 except that a kind and added amount of fluorine based resin particles of the charge transporting layer 2 (CTL2) were changed as shown in Table 1.

TABLE 1

| | Charge transporting layer 2 | | | | | | |
|---|---|---|---|---|---|---|---|
| Photo-receptor No. | Kinds of fluorine based resin particle | Number average primary order particle diameter (μm) | Crystallin-ity (%) | Added amount (parts) | Contact angle (°) | Dispersion of contact angle (°) | Remarks |
| 1 | PTFE-1 | 0.12 | 82.2 | 200 | 112 | 1.4 | |
| 2 | PTFE-2 | 0.03 | 73.4 | 200 | 115 | 0.8 | |
| 3 | PTFE-3 | 0.19 | 86.2 | 200 | 108 | 1.8 | |
| 4 | PTFE-4 | 0.01 | 74.6 | 200 | 95 | 2.2 | Comp. |
| 5 | PTFE-5 | 0.22 | 86.4 | 200 | 98 | 2.3 | Comp. |
| 6 | PTFE-6 | 0.12 | 89.1 | 200 | 107 | 1.6 | |
| 7 | PTFE-7 | 0.12 | 91.3 | 200 | 105 | 2.2 | Comp. |
| 8 | PTFE-1 | 0.12 | 82.2 | 100 | 92 | 1.9 | |
| 9 | PTFE-1 | 0.12 | 82.2 | 50 | 88 | 2.4 | Comp. |
| 10 | PTFE-1 | 0.12 | 82.2 | 300 | 118 | 1.2 | |
| 11 | PTFE-1 | 0.12 | 82.2 | 400 | 128 | 1.0 | |
| 12 | H | 0.12 | 45 | 200 | 108 | 1.8 | |

In Table 1, PTFE, and H show the following fluorine based resin fine particles.

PTFE: Polyethylene-terephthalate-resin particles

H: Copolymerization resin particles of ethylene trifluoride-ethylene tetrafluoride Moreover, contact angle and dispersion in contact angle in Table 1 were measured by the above mentioned method.

<Evaluation>

The obtained photoreceptor was mounted in a commercial color printer magicolor2200DeskLaser (made by Minolta QMS company), and durability test was performed. In detail, total 20,000 sheets of a character image and a halftone image were printed, and the evaluation was conducted at the start time and for every 5000 sheets. Evaluation items and criterion for evaluation are shown as follows.

Incidentally, process condition of the above-mentioned color printer was made into the following conditions.

Charging device: Saw-tooth electrode

Light-exposure device: Semiconductor laser

Developing: Nonmagnetic toner with an average particle diameter of 6.5 μm, toner containing external additive agent of 0.3 μm strontium titanate and 15 nm hydrophobic silica Reversal Development Method Transfer: Intermediate transfer roller use Cleaning: Cleaning blade Fixing: Heating fixing Process speed: 100 mm/sec (Unevenness)

A: In any of the half tone image which was in agreement with the scratch on the surface of the photoreceptor, a streak-like unevenness was not seen at all through printing of 20,000 sheets;

B: Although a slight streak-like unevenness was seen through printing of 20,000 sheets in a part of photoreceptor surface, a streak-like unevenness was not seen at all in the half tone image;

C: During printing of 20,000 sheets, a streak-like unevenness was clearly seen all over the half tone image which was in agreement with the scratch on the surface of a photoreceptor.

(Blur Image)

A: occurrence of a blur image was not seen at all through printing of 5000 sheets (excellent).

B: Although a partially blur image occurred on several sheet (less than ten sheets) through printing of 5000 sheets. No problem for practical use (practically with no problem)

C: A partially blur image occurred on ten or more sheets or a wide range blur image occurred one or more sheet during printing of 5000 sheets.

Black Spot

The occurrence situation of black spot on a halftone image (strawberry-like spot image) was judged on the following basis.

A: An occurrence core of a black spot was not seen on a photoreceptor, and no occurrence of a black spot on a halftone image was seen (good)

B: Although an occurrence core of a black spot was seen on a photoreceptor, no occurrence of a black spot on a halftone image was not seen (practically with no problem)

C: An occurrence core of black spot was seen on a photoreceptor, an occurrence of a black spot on a halftone image was seen (Sharpness)

Sharpness of image was evaluated with character collapse. Character images differing in printed character sizes (point) were formed, and the character images were evaluated based on the following criterion of judgment.

A: The characters of six or less points were clear, and they were decipherable easily (excellent).

B: The characters of four or less points were clear, and they were decipherable easily (practically with no problem).

C: The characters of eight or less points were clear, and they were decipherable easily (reevaluation was needed).

D: The characters of eight points were partially or entirely not decipherable.

TABLE 2

| Photoreceptor No. | Image unevenness | Blur image | Black spot | Sharpness |
|---|---|---|---|---|
| 1 | A | A | A | A |
| 2 | A | A | B | A |
| 3 | A | A | B | A |
| 4 | B | A | C | B |
| 5 | B | A | C | C |
| 6 | A | A | A | A |
| 7 | B | A | C | B |
| 8 | A | A | B | B |
| 9 | C | A | C | C |
| 10 | A | A | A | A |
| 11 | B | B | A | B |
| 12 | B | A | B | A |

As can be seen from Table 2, in organic photoreceptors 1-3, 6, 8, 10-12 having a surface layer (=charge transporting layer 2) which contains fluorine-containing resin fine particles whose number average first order particle diameter is 0.02 μm or more and less than 0.20 μm and degree of crystallinity is less than 90% and binder resin and has a contact angle of 90° or more and a dispersion in contact angle of ±2.0°, an unevenness, a blur image, a black spot, and a sharpness on any one of the photoreceptors were improved. On the other hand, in the photoreceptor 4 using PTFE-4 whose number average first order particle diameter was 0.01 μm the dispersibility of fluorine-containing resin fine particles of the surface layer was inferior, the dispersion in contact angle became large with 2.2, and black spot has occurred. Moreover, in the photoreceptor 5 using PTFE-5 whose number average first order particle diameter is 0.22 μm, the dispersion in contact angle of the surface layer became large with 2.3, black spot had occurred, scattering of laser light exposure also increased, and sharpness has also deteriorated. Moreover, in the photoreceptor 7 using PTFE-7 whose degree of crystallinity was 91.3, the dispersion in contact angle of the surface layer became large with 2.2, and black spot has occurred. Moreover, in the photoreceptor 9 in which the content of PTEF-1 in the surface layer (=charge transporting layer 2) was reduced and the contact angle is lowered to 88, occurrence of unevenness and a black spot was seen and sharpness has deteriorated.

What is claimed is:

1. An organic photoreceptor, comprising:

a conductive support;

a photosensitive layer provided on the conductive support; and a surface layer containing a binder and a fluorine-containing resin fine particle having a number average primary particle diameter from 0.02 μm inclusive to 0.20 μm exclusive and a crystallinity from 40% inclusive to 90% exclusive and a binder resin, the surface layer containing 20 mass parts to 200 mass parts of the fluorine-containing resin fine particle for 100 mass parts of the binder resin;

said surface layer has an average contact angle value of several positions of 90° or more for water, and the contact angle value farthest from the average value in the positive and negative directions are within 2.0°.

2. The organic photoreceptor of claim 1, wherein said binder resin contains siloxane-modified polycarbonate.

3. The organic photoreceptor of claim 2, wherein said surface layer contains an antioxidant.

4. The organic photoreceptor of claim 3, wherein said contact angle is from 95° to 120°, said contact angle value farthest from the average value in the positive and negative directions are within 1.7°, the crystallinity is from 40% inclusive to 90% exclusive, and the surface layer contains 20 mass parts to 200 mass parts of the fluorine-containing resin fine particle for 100 mass parts of the binder resin.

5. The organic photoreceptor of claim 1, wherein said surface layer contains an antioxidant.

6. The organic photoreceptor of claim 1, wherein said average contact angle is from 95° to 120°.

7. The organic photoreceptor of claim 1, wherein said contact angle value farthest from the average value in the positive and negative directions are within 1.7°.

8. The organic photoreceptor of claim 1, wherein said fluorine-containing resin fine particle is at least one of a homopolymer or a copolymer of a fluorine-containing monomer and a copolymer of a fluorine-containing monomer and fluorine free monomer.

9. The organic photoreceptor of claim 1, wherein said fluorine-containing monomer is a monomer represented by the following general formula:

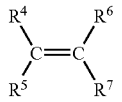

wherein in the formula, at least one group among $R^4$-$R^7$ is a fluorine atom, and the remaining groups are a hydrogen atom, a chlorine atom, a methyl group, a monofluoro methyl group, a difluoro methyl group, or a trifluoro methyl group independently respectively.

10. The organic photoreceptor of claim 1, wherein said photosensitive layer includes a charge generating layer and a charge transporting layer, the charge transporting layer includes plural layers, and the uppermost layer of the plural layer is the surface layer.

11. A method of producing an organic photoreceptor having a photosensitive layer on a conductive support, comprising:

dispersing a fluorine-containing resin fine particle, having a binder resin and a number average primary particle diameter from 0.02 μm inclusive to 0.20 μm exclusive and a crystallinity from 40% inclusive to 90% exclusive and a binder resin into an organic solvent having a boiling point of 120° or less under atmospheric pressure, so as to form a coating solution, the coating solution containing 20 mass parts to 200 mass parts of the fluorine-containing resin fine particle for 100 mass parts of the binder resin; and coating the coating solution on a support to form a surface layer, wherein contact angle for water is 90° or more and dispersion of the contact angle is within ±2.0°.

12. A process cartridge, comprising:

the organic photoreceptor described in claim 1;

at least one section of a charging section to charge uniformly the organic photoreceptor, a latent image forming section to form an electrostatic latent image on the charged organic photoreceptor, a developing section to visualize the electrostatic latent image on the charged organic photoreceptor to form a toner image, a transferring section to transfer the visualized toner image from the organic photoreceptor to a transfer material, a discharging section to eliminate charges on the organic photoreceptor after transferring the toner image, and a cleaning section to remove toner remaining on the organic photoreceptor after transferring the toner image; and a cartridge housing in which the organic photoreceptor and the at least one section are supported as one body capable of being mounted detachably in an image forming apparatus.

13. An electrophotographic image forming apparatus, comprising:

the organic photoreceptor described in claim 1.

14. The electrophotographic image forming apparatus of claim 13, further comprising:

a charging section configured to charge uniformly the organic photoreceptor;

a latent image forming section configured to form an electrostatic latent image on the charged organic photoreceptor;

a developing section configured to visualize the electrostatic latent image on the charged organic photoreceptor to form a toner image;

a transferring section configured to transfer the visualized toner image from the organic photoreceptor;

a discharging section configured to eliminate charges on the organic photoreceptor after transferring the toner image; and a cleaning section configured to remove toner remaining on the organic photoreceptor after transferring the toner image.

15. The electrophotographic image forming apparatus of claim 14, further comprising:

an intermediate transferring member to hold the toner image before transferring toner image from the organic photoreceptor to a transfer material.

16. The electrophotographic image forming apparatus of claim 14, wherein said binder resin contains siloxane-modified polycarbonate.

17. The electrophotographic image forming apparatus of claim 14, wherein said contact angle is about 95° to about 120°, and said contact angle value farthest from the average value in the positive and negative directions are within 1.7°.

18. The electrophotographic image forming apparatus of claim 14, wherein the fluorine-containing monomer is a monomer represented by the following general formula:

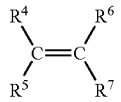

wherein in the formula, at least one group among $R^4$-$R^7$ is a fluorine atom, and the remaining groups are a hydrogen atom, a chlorine atom, a methyl group, a monofluoro methyl group, a difluoro methyl group, or a trifluoro methyl group independently respectively.

* * * * *